United States Patent [19]

Kauffman

[11] Patent Number: 4,627,616

[45] Date of Patent: Dec. 9, 1986

[54] EXERCISE APPARATUS

[76] Inventor: Brad Kauffman, 35 Back Cove Estates, Portland, Me. 04103

[21] Appl. No.: 753,321

[22] Filed: Jul. 9, 1985

[51] Int. Cl.[4] ..... A63B 21/00

[52] U.S. Cl. ..... 272/120; 272/134; 182/141

[58] Field of Search ..... 187/20, 21; 272/120, 272/126, 117, 118, 134, 138; 254/243, 263; 182/141; 272/91

[56] References Cited

U.S. PATENT DOCUMENTS

| | | | |
|---|---|---|---|
| 66,170 | 6/1867 | Patterson | 182/141 X |
| 197,750 | 12/1877 | Tuttle | 272/120 |
| 201,606 | 3/1878 | Harmon | 272/120 |
| 479,524 | 7/1892 | Nicholson | 272/91 |
| 1,273,143 | 7/1918 | Bryan | 182/141 X |
| 3,126,071 | 3/1964 | Basset | 272/120 X |
| 4,064,999 | 12/1977 | Young | 182/141 X |
| 4,273,306 | 6/1981 | Chang | 182/141 X |
| 4,500,089 | 2/1985 | Jones | 272/117 |

*Primary Examiner*—Richard J. Apley
*Assistant Examiner*—Robert W. Bahr

[57] ABSTRACT

An exercise device is provided requiring no external resistance devices, such as weights, wherein the individual may position himself on a movable platform which engages a track that guides the movement of a platform relative to the stationary track whereby an application of an external force upon a lever integral with the platform engages a cable which effectively moves the platform relative to the track.

10 Claims, 4 Drawing Figures

EXERCISE APPARATUS

BACKGROUND OF THE INVENTION

1. Field of the Invention

This invention is directed to an exercise machine. More particularly, the present invention is directed to an exercise machine permitting a full range of exercises, including weight lifting exercises, wherein the body weight of the exercising individual provides resistance against which said exercises are performed.

2. Information Disclosure and Objects

In designing an exercise machine suitable to today's marketplace various considerations must be taken into account, including ease of transport and adaptability to various individuals as well as to different exercises. The exercise machine should, for example, provide for a full range of exercises including those for flexibility, body building, aerobics, and the like. It should also be adaptable to various theories and methods of exercise.

Conventional weight lifting and body building devices, inclusive of universal gyms and the like, generally require an external source of resistance (e.g. iron weights), are complicated, and are generally inflexible. These machines, for example, provide only a typical range of weights and resistance levels and cannot accommodate the novice or beginning exerciser through advanced and expert levels of training, body building, and the like.

While other exercising devices do not require external weights, they generally utilize mechanical mechanisms such as springs and the like to provide resistance to the exercise. These mechanisms, however, provide a variable, non-uniform resistance to the exercise and generally deteriorate over a period of time. Still yet a further disadvantage of the these machines is that they are not universal. They do not support a full range of even the conventional weight lifting exercises, let alone accommodate an individual with a specifically designed exercise program. Most often, a plurality of different machines are required to work different muscle groupings and/or accommodate a specific exercise routine.

It is therefore an object of the present invention to eliminate the foregoing disadvantages and provide a truly universal exercising machine which overcomes the foregoing defects.

A further object of the present invention is to provide a exercising machine which can virtually accommodate all individual exercising levels from beginner to expert throughout a full range of exercises which can include conventional weight lifting exercises, a full range of flexibility exercises, aerobic exercises, as well as specifically designed exercise programs tailored to an individuals requirements.

Yet a further object of the present invention is to provide an exercising machine which may utilize the individuals own weight to achieve and supplement the various resistance levels provided by the machine, while providing a uniform resistance throughout various exercises.

Still yet a further object is to provide an exercising device which through its various mechanisms provides an entire range of mechanical advantages to accommodate exercises and exercising levels throughout a full range of external force requirements so that the exercising machine accommodates exercises requiring little or no exertion or external force to a level requiring a very strenuous level of exertion, which levels can exceed by several times the body weight of the individual.

Various other objects and advantages of the present invention will be more fully understood from a thorough reading of the detailed description of the preferred embodiment, the claims and the drawing figures, wherein:

BRIEF DESCRIPTION OF THE DRAWING FIGURES

DETAILED DESCRIPTION OF THE PREFERRED EMBODIMENT

Figure 1:
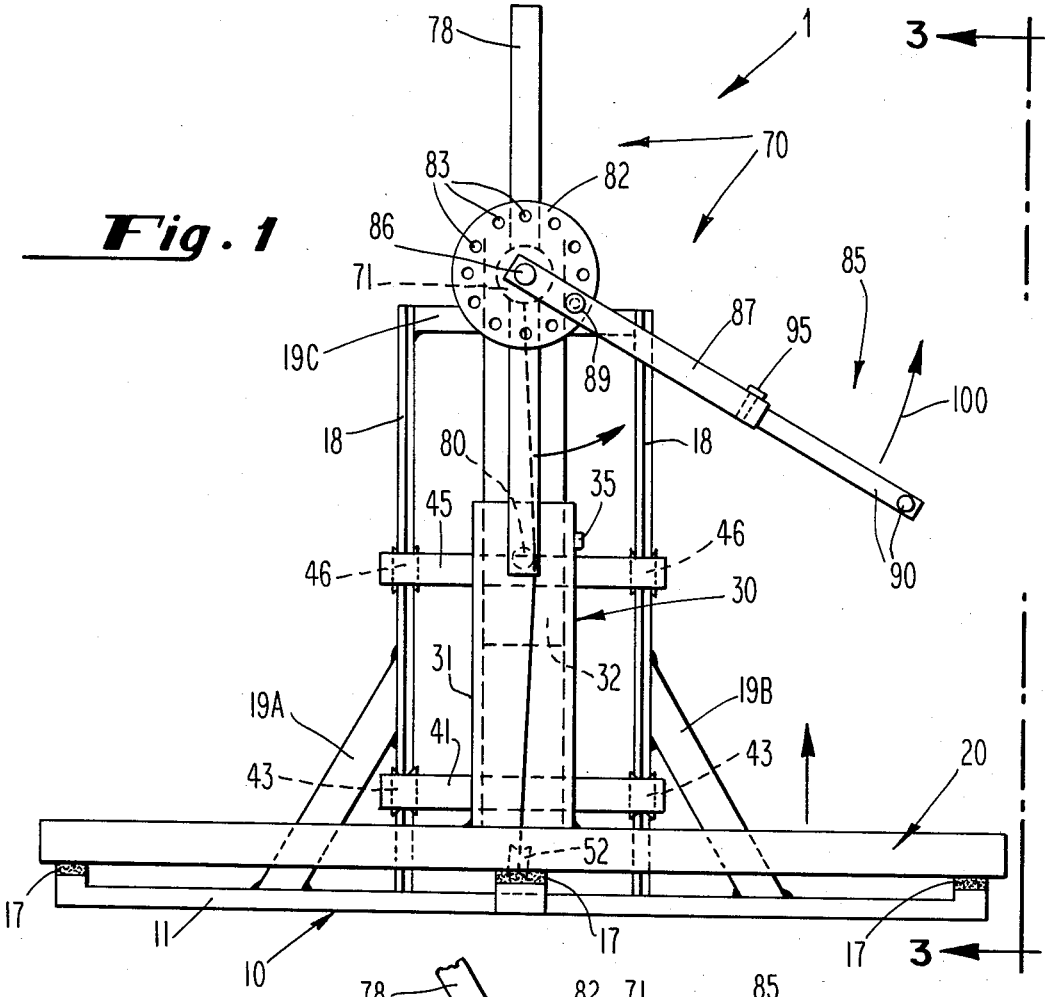
FIG. 1 is a front elevational view of the exercising machine of the present invention.

The exercising machine of the present invention, generally designated by numeral 1, comprises stand means 10, platform means 20 consisting of column means 30 and tracking means 40, cable means 50, reel means 60 and lever means 70, which in turn consists of attachment means 85. It is to be understood that exercise machine 1 may be fabricated of various materials including light weight high strength plastics, aluminum, and steel, however, in the preferred embodiment, a light weight high strength aluminum alloy, as is known in the art, is utilized.

Figure 2:
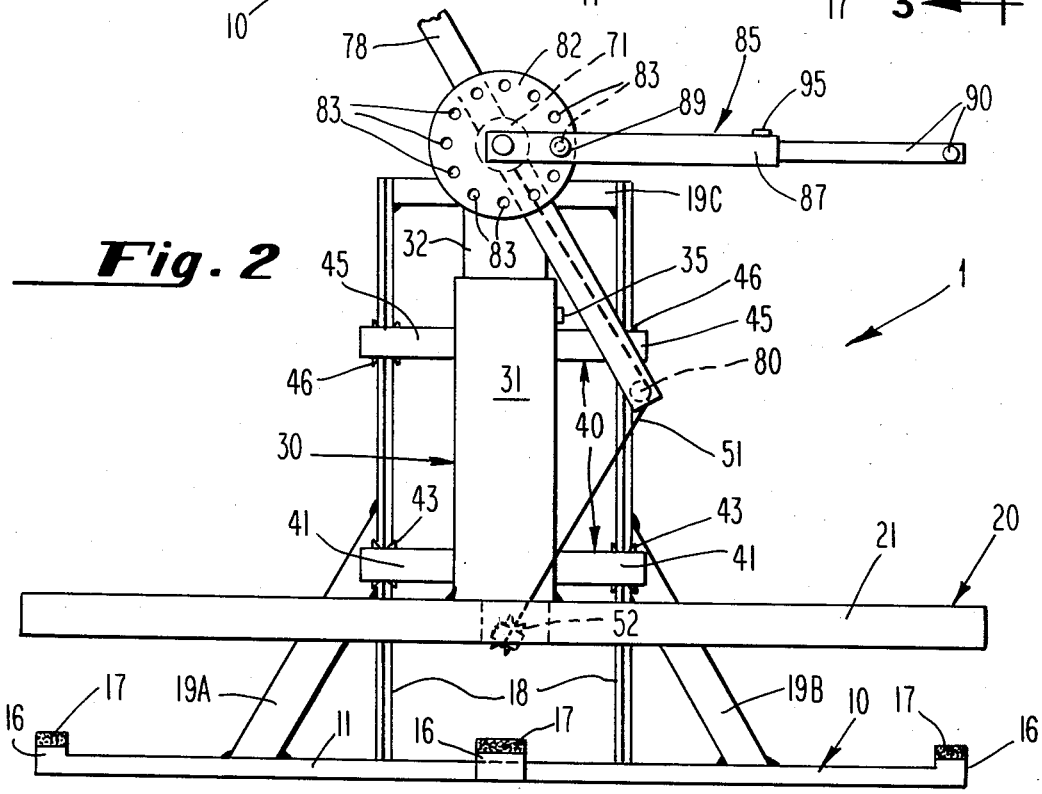
FIG. 2 is a front elevational view of the present invention after an external force has been exerted upon the exercising machine.
Figure 3:
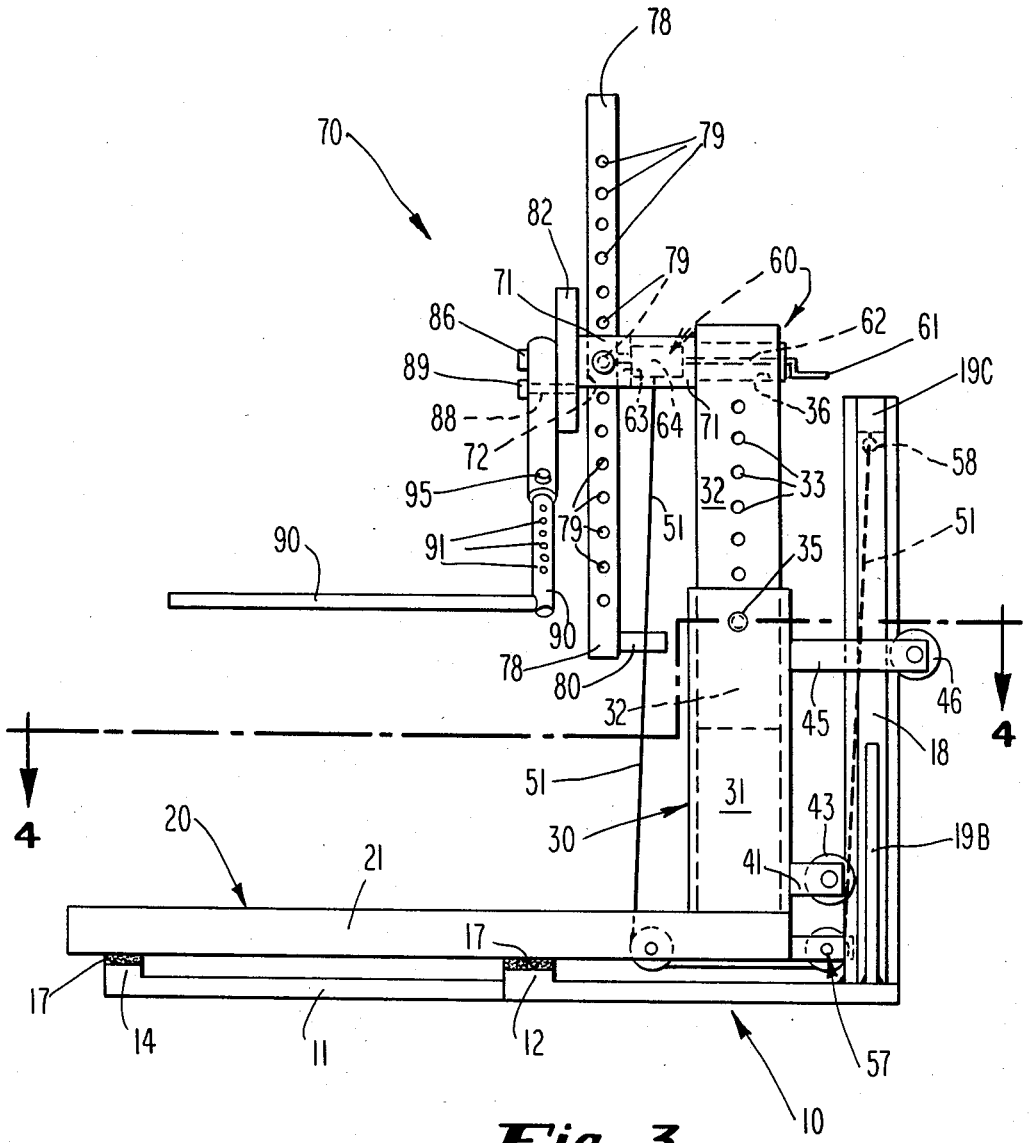
FIG. 3 is a side elevational view of the exercising of the present invention taken along the lines 3—3 of FIG. 1.
Figure 4:
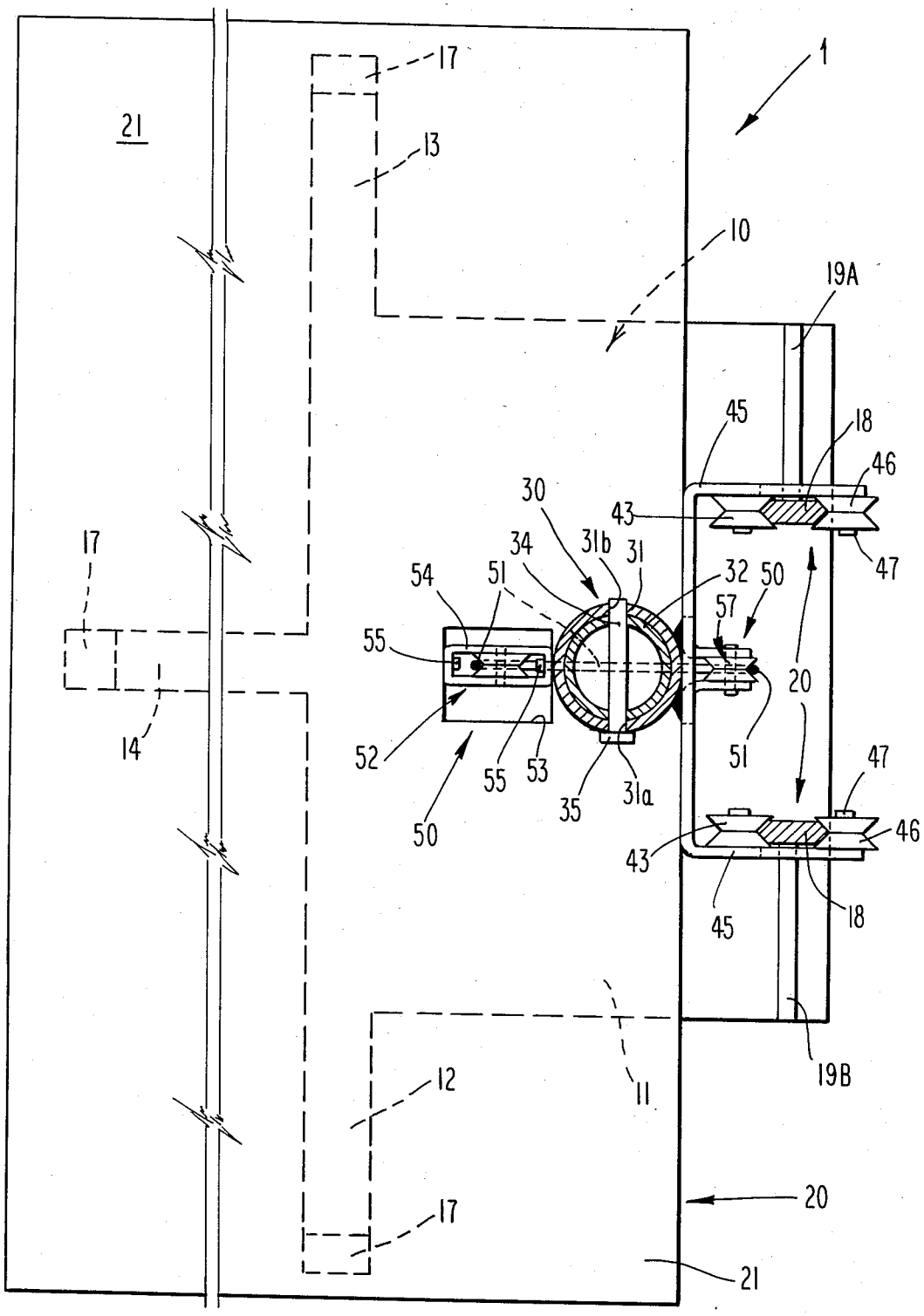
FIG. 4 is a sectional plan view of the exercising machine of the present invention taken along the lines 4—4 of FIG. 3.

Referring now to FIGS. 1 and 4, it can be seen that stand means 10 consists of a floor support 11 with extending side arms 12 and 13 and extending central arm 14 as are best shown in FIG. 4. Extending arms 12, 13 and 14 each are provided with an upwardly extending portion 16 being provided with a cushioning member which in the preferred embodiment is rubber pad 17. As is best seen in FIGS. 1 and 3, rubber pad 17 contacts floor 21 of platform means 20 to effectively support same when exercise machine 1 is in its rest position. Welded to base 11 are tracks 18 which in cross section are heptagonal members as shown in FIG. 4. Tracks 18 are firmly secured with base 11 and held in parallel relationship with each other by virtue of side braces **19*a* and 19*b*, which are each welded to base 11 and tracks 18 as shown in FIG. 2; they are further secured by support member 19*c*, which is welded between and to tracks 18 at the uppermost end of tracks 18 (FIG. 2**).

Base 21 of platform means 20 provides, in the preferred embodiment, a large surface which can accommodate the entire body of an individual either standing or lying down as well as other articles such as benches, chairs or the like, which are required or may desirably be utilized in connection with the exercises being performed. The present invention also contemplates exercise machine 1 being fabricated in a very compact manner and designed to be completely portable.

With reference to FIGS. 3 and 4, it can be seen that the base 31 of column means 30 is welded to floor 21 of platform means 20, and in the preferred embodiment is a tubular member (FIG. 4) which slidably engages a second and concentrically positioned tubular member 32, containing openings 33. In the preferred embodiment, column 31 likewise contains openings 31*a* and 31*b* and therefore, the total heighth of column means 30 may be adjusted by adjusting the individual heigth of column member 32 such that holes 33 are aligned with holes 31*a* and 31*b* of column 31, whereby pin 34 having pin head 35 is inserted through these openings to affix column 31 and 32 with each other to attain the desirable heighth of column means 30.

Tubular member 32 of column means 30 also contains bore holes 36 (FIG. 3) for supporting and permitting rotation therein of axle 71. In the preferred embodiment axle 71 is a tubular member having opposed rectangular openings 72 and opposed pin openings (not shown) to accommodate push pull pin 73 which fixedly locates lever 78 with axle 71 as is more fully described hereinbelow. Centrally located and supported within axle 71 is reel means 60 which comprises crank shaft 61, having shaft 62 rotatable secured with reel stop plate 63, wherein shaft 62 has fixedly secured therewith reel member 64 about which cable 51 may be wound and unwound in response to turning crank handle 61 of reel means 60. Reel means 60 additionally comprises a locking mechanism for securing reel means 60 with axle 71 when desired. In the preferred embodiment the locking mechanism comprises a ratchet and pall as is known in the art.

As is best seen in FIG. 3, lever means 70 includes lever 78 having openings 79 and extension engagement piece 80 mounted at the end thereof, to engage cable 51 upon rotation of lever 78. Lever means 70 further includes face plate 82 having holes 83 circumferentially located about face plate 82. In the preferred embodiment, face plate 82 is welded to axis 71 of lever means 70 and yet further includes attachment means 85. Attachment means 85 consists of threaded bolt 86 which passes through openings (not shown) in arm 87 to engage threaded opening (not shown) in face plate 82. Arm 87 is likewise provided with a further opening 88 through which pin 89 passes for engagement with holes 83 of face plate 82. Arm 87 has provided concentrically therein, arm 90 which slidably engages arm 72, is generally L-shaped and contains holes 91 through which push pull mechanism 95 protrudes for engaging and affixing extension arm 90 with arm 87 of attachment means 85.

Referring now to FIGS. 3 and 4, it is seen that platform means 20 is movably secured with stand means 10 by track means 40 which consists of cross member 41 which is welded to column means 30 along tubular member 31 and extends to either side of tubular member 31 for a distance extending just beyond tracks 18. Rollers 43, which are fashioned to engage tracks 18 are secured to extension member 42 by pin 44, which firmly secures the rollers while permitting them to rotate about pin 44. Rollers 42 engage the front most portion of track 18. In similar manner, an upper cross bar 45 is welded to tubular member 31 as is illustrated in FIG. 4 and comprises a relatively U-shaped member as depicted in FIG. 4, to which is secured rollers 46 by virtue of pin 47. Rollers 46 are rotatably attached to cross bar 45 by pins 47 in a manner which enables rollers 46 to engage track 18 at its rearward most end. By virtue of this arrangement of cross bars 41 and 45 and their engagement through rollers 43 and 46 with track 18, platform means 20 is fixedly secured with stand means 40 in a manner which permits platform means 20 to freely move upwardly and downwardly relative to stand means 10, while being guided by tracks 18 in response to the movement of cable means 50 as were fully described hereinbelow.

With specific reference to FIGS. 2, 3 and 4, it can be seen that cable means 50 consists of cable 51 which is wound about reel 64, thereby affixing cable 51 with axle 71 of lever means 70. Upon actuation of lever means 70 by exerting an external force upon bar 90 which transmits this force through attachment means 85, rotating face plate 82 and therefore axle 71 and in turn rotating lever arm 78, engagement extension arm 80 is contacted with cable 51. Cable 51 is in turn threaded through platform pully means 52, which includes a substantially rectangular opening 53 in platform 11 (FIG. 4). Pulley bracket 54 is pivotally mounted within rectangular opening 53 of platform 11 by pins 55 allowing wheel 56 which is rotatably mounted within bracket 54 to swivel together with bracket 54 in response to the cable 51 angle as is illustrated in FIG. 2. Cable 51 thereafter passes beneath floor 11 of platform 20 and engages pulley 57 which functions to string the pulley rewardly of column 30 and track means 40 permitting freedom of travel between tracks 18. Cable 51 is ultimately secured to pin 58 which is secured with uppermost cross member 19*c*.

In operation of exercise machine 1, as illustrated in FIGS. 1 and 2, it can be seen that upon exertion of an external force to exercise machine 1 (designated by arrow 100), arm 90 of attachment means 85 is rotated upwardly, moving face plate 82 counter clockwise and causing lever arm 78 by virtue of engagement extension means 80 to contact cable 51 of cable means 50, which due to its affixation with stand means 10 and particularly cross member 19*c*, causes base 21 of platform means 20 to move upwardly along tracks 18.

In the preferred embodiment, it is envisioned that one utilizing exercise machine 1 would stand, sit, or lie down or position oneself upon base 21 of platform means 20 in the required manner to perform the desired exercise. The weight of the individual would therefore become a source of resistance to the exercise to be conducted. While it is to be understood that base 21 of platform means 20 could solely provide the resistance for a specified exercise, or could in addition to the exerciser weight provide such resistance, in the preferred embodiment, it is the exercisers own weight which provides such resistance.

As should be fully understood from the foregoing description, various adjustments may be made to attachment means 85 to effect the amount of leverage obtained by variously positionable bar 90 with respect to arm 87. Likewise it is contemplated, that attachment means 85 or its component parts including arm 90 could be replaced with other attachments or various shaped apparatus and mechanisms to accomodate almost any variation of exercise imaginable. Additionally, it can be seen that face plate 82 and its engagement with attachment means 85 can easily be changed to position attachment 85 in a manner which accommodates the exercise to be performed, by simply removing pin 89 rotating attachment means 85 clockwise or counter clockwise about face plate 82 until the desired affixation location is obtained; pin 89 is then placed through hole 88 and holes 83 of face plate 82 to secure attaching means 85 to face plate 82. It will likewise be understood that in view of the design of column means 30, tubular member 32 may be adjusted upwardly or downwardly causing axle 71 and therefore face plate 82 and attachment means 85 to move upwardly and downwardly in response to the adjustment of tubular member 32 thereby further varying the types of exercises which can be performed, permitting adjustment and adaptation of the mechanism to individuals of various sizes and the like. As is evident from the description hereinbefore, adjustment of the height of tubular member 32 merely requires adjustment of reel means 60 in a manner which maintains the cable in taught position. Cable 51 is simply wound or unwound about reel 64 to the desired position, after which reel means 60 is locked by the ratchet and pall mechanism to affix reel 64 with axle 71.

As is recognized from the foregoing description, there are many ways to vary the leverage or external force 100 required to move platform means 20 and any resistance force thereon. It should be understood however that lever arm 78 and its attachment with axle 71 is in the preferred embodiment the main adjustment means for varying the external exertion required to move platform means 20 from its stationery position. As is best shown in FIG. 3, the further the length of lever 78 between axle 71 and engagement extension 80, the greater the exertion required to effectively move platform means 20. In this fashion exercise machine 1 can be adjusted to effectively vary the resistance level of the individual exercising from a negligible resistance, to one which effectively multiplies the weight upon platform means 20 (e.g. the individual exercisers weight) by several fold.

As will be understood from a thorough review of the patent application when considered with the drawing figures and claims herein, exercise machine 1 may be utilized in a variety of applications apart from those described in the preferred embodiment. Moreover, it should be understood that exercise machine 1 with minor modifications has applicability to any number of a different types of applications and therefore, it is to be understood that the form of the invention shown herein and described is to be taken only as a preferred example of the present invention and that various changes and modifications may be made without departing from the scope of the invention.

What is claimed is:

1. An exercising machine comprising: stationary frame means including track means; platform means movably engaging said track means; cable means for moving said platform means along said track means in response to an external force; lever means mounted to said platform means for producing means against which said external force may be applied and for permitting engagement with said cable means at various locations to vary the amount of said external force required to be applied to said lever means to move said platform means in relation to said stationary frame means.

2. An exercising machine as in claim 1, wherein the operation of said platform means along said track means in part provides resistance against which said external force operates.

3. An exercising machine as in claim 2, wherein the weight of an individual on said movable platform forms an additional resistance against which said external force operates to move said platform means along said track means.

4. An exercising machine as in claim 3, wherein said track means is relatively perpendicular to said stationary frame means.

5. An exercising machine as in claim 1, wherein said platform means further includes column means secured to said platform means, for raising and lowering said lever means relative to said platform means.

6. An exercising machine as in claim 5, wherein said cable means further includes reel means for adjusting said cable means in accordance with said raising and lowering of said column means.

7. An exercising machine as in claim 5, wherein said lever means further includes an axle means pivotally mounted with said column means, a lever arm having means for fixedly but adjustably securing said lower arm with said axle means, and attachment means adjustably secured with said axle for engaging said cable at said various locations.

8. An exercising machine comprising: stationary frame means; track means secured to said stationary frame means; platform means movably engaging said track means; cable means for moving said platform means along said track means in response to an external force wherein said track means forms a vertical track relatively perpendicular to said platform means, said platform means in part providing resistance against which said external force operates; and lever means, mounted to said platform means in a manner permitting engagement with said cable means in response to the application of said external force, wherein said platform means further includes adjustable column means secured to said platform means, said column means for raising and lowering said lever means relative to said platform means, said cable means including reel means for adjusting said cable means in accordance with said raising and lowering of said column means, whereby application of said external force causes said lever means to engage said cable means and move said platform means in relation to said stationary frame means.

9. An exercising machine as in claim 1, wherein said lever means further includes' an axle pivotally mounted with said column means, said axle having secured therewith said reel means; a lever arm having means for fixedly, but adjustably securing said lever arm with said axle and means for engaging said cable; and attachment means, adjustably secured with said axle, for providing variously positionable mechanisms against which said external force is to be applied to facilitate different exercises, wherein exertion of said external force against said attachment means rotates said axle, which pivots said lever arm against said cable, said cable operating in conjunction with said platform to provide resistance to said external force.

10. An exercising machine as in claim 9, wherein said cable means further includes a cable and said reel means further includes a surface about which said cable is wound and unwound.

* * * * *